US009022874B2

(12) United States Patent
Hatton et al.

(10) Patent No.: US 9,022,874 B2
(45) **Date of Patent: *May 5, 2015**

(54) PUTTER HEADS AND PUTTERS HAVING ADJUSTABLE, MULTI-SIDED BALL STRIKING FACE INSERT

(75) Inventors: Philip J. Hatton, Beaverton, OR (US); Andrew G. V. Oldknow, Beaverton, OR (US); Jeremy N. Snyder, Benbrook, TX (US); Donald S. Rahrig, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 62 days.

This patent is subject to a terminal disclaimer.

(21) Appl. No.: 13/812,444

(22) PCT Filed: Jul. 20, 2011 (Under 37 CFR 1.47)

(86) PCT No.: PCT/US2011/044615

§ 371 (c)(1), (2), (4) Date: Aug. 12, 2013

(87) PCT Pub. No.: WO2012/015638

PCT Pub. Date: Feb. 2, 2012

(65) Prior Publication Data

US 2014/0148268 A1 May 29, 2014

Related U.S. Application Data

(63) Continuation of application No. 12/843,974, filed on Jul. 27, 2010, now Pat. No. 8,353,780.

(51) Int. Cl.

| | |
|---|---|
| ***A63B 69/36*** | (2006.01) |
| ***A63B 53/04*** | (2006.01) |
| ***A63B 53/06*** | (2006.01) |

(52) U.S. Cl.

CPC ..... *A63B 53/065* (2013.01); *A63B 2053/0425* (2013.01); *A63B 2053/0445* (2013.01);

(Continued)

(58) Field of Classification Search

CPC ..... A63B 53/0487; A63B 2053/042; A63B 2053/0441; A63B 53/065; A63B 2053/0425; A63B 2053/0445

USPC ..... 473/324–350, 287–292, 219–256

See application file for complete search history.

(56) References Cited

U.S. PATENT DOCUMENTS

| | | | |
|---|---|---|---|
| 5,415,399 | A | 5/1995 | Kettelson |
| 5,938,543 | A | 8/1999 | McGeeney et al. |

(Continued)

FOREIGN PATENT DOCUMENTS

| | | |
|---|---|---|
| CN | 2507510 Y | 8/2002 |
| EP | 0118381 | 9/1984 |

(Continued)

OTHER PUBLICATIONS

International Search Report for corresponding PCT Application No. PCT/US2011/044615 mailed on Sep. 1, 2011.

(Continued)

*Primary Examiner* — Sebastiano Passaniti

(74) *Attorney, Agent, or Firm* — Banner & Witcoff Ltd.

(57) ABSTRACT

Golf clubs and golf club heads, such as putter heads (102), may include a putter body and an adjustable ball striking face insert (116) forming at least a portion of the ball striking face (104) and contained within the putter body. The insert (116) may have a plurality of sides (118*a*, 118*b*, 118*c*, 118*d*), each of the sides having different performance characteristics to permit customization of the putter (100). In some examples, the adjustable ball striking face insert (116) may be rotatably mounted within the putter head. Additionally or alternatively, the insert (116) may be removably mounted within the putter head (102). In some arrangements, the insert (116) may be finely adjustable to alter the loft angle of the putter head (102).

22 Claims, 12 Drawing Sheets

(52) U.S. Cl.
CPC ..... *A63B53/0487* (2013.01); *A63B 2053/0441* (2013.01); *A63B 2053/042* (2013.01); *A63B 2209/00* (2013.01)

(56) References Cited

U.S. PATENT DOCUMENTS

| | | | | |
|---|---|---|---|---|
| 6,001,030 | A | 12/1999 | Delaney | |
| 6,086,484 | A | 7/2000 | Uebelhor | |
| 6,227,986 | B1 | 5/2001 | Fisher | |
| 6,270,423 | B1 | 8/2001 | Webb | |
| 6,863,620 | B2 | 3/2005 | Tucker, Sr. | |
| 7,341,527 | B1 | 3/2008 | Fisher | |
| 7,442,129 | B2 | 10/2008 | Bardha | |
| 7,594,862 | B2 * | 9/2009 | Gilbert | 473/330 |
| 8,353,780 | B2 * | 1/2013 | Hatton et al. | 473/244 |
| 2005/0009623 | A1 | 1/2005 | Dickinson | |
| 2005/0130764 | A1 | 6/2005 | Frame | |
| 2007/0161430 | A1 | 7/2007 | Bardha | |
| 2010/0048320 | A1 | 2/2010 | Burrell | |
| 2010/0087269 | A1 | 4/2010 | Snyder et al. | |

FOREIGN PATENT DOCUMENTS

| | | | |
|---|---|---|---|
| FR | 2541903 | A1 | 9/1984 |
| GB | 190623691 | | 7/1907 |

OTHER PUBLICATIONS

Office Action Mailed Jul. 28, 2014 in Chinese Application 201180046464.0.

* cited by examiner

PUTTER HEADS AND PUTTERS HAVING ADJUSTABLE, MULTI-SIDED BALL STRIKING FACE INSERT

FIELD OF THE INVENTION

The invention relates generally to putter heads and putters. Putter heads and putters in accordance with at least some examples of this invention may include an adjustable ball striking face insert having a plurality of sides having different performance characteristics.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well known golf superstars, at least in part, have increased golf's popularity in recent years both in the United States and across the world.

Golfers at all skill levels seek to improve their performance, lower their golf scores, and reach that next performance "level." Manufacturers of all types of golf equipment have responded to these demands, and recently, the industry has witnessed dramatic changes and improvements in golf equipment. For example, a wide range of different golf ball models now are available, with some balls designed to complement specific swing speeds and/or other player characteristics or preferences, e.g., with some balls designed to fly farther and/or straighter, some designed to provide higher or flatter trajectories, some designed to provide more spin, control, and/or feel (particularly around the greens), etc. A host of swing aids and/or teaching aids also are available on the market that promise to help lower one's golf scores.

Being the sole instruments that set golf balls in motion during play, golf clubs also have been the subject of much technological research and advancement in recent years. For example, the market has seen improvements in putter designs, golf club head designs, shafts, and grips in recent years. Additionally, other technological advancements have been made in an effort to better match the various elements and/or characteristics of the golf club and/or characteristics of a golf ball to a particular user's swing features or characteristics (e.g., club fitting technology, ball launch angle measurement technology, ball spin rate characteristics, etc.).

Golfers tend to be sensitive to the "feel" of a golf club, particularly with respect to putters. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, and the like all may affect the "feel" of the club as it swings and strikes a ball. "Feel" also has been found to be related to the visual appearance of the club and the sound produced when the club head strikes a ball to send the ball in motion.

While technological improvements to golf club designs have been made, because of the very personal nature of the putter stroke and the "feel" aspects of putting a golf ball, no single putter structure is best suited for all players. New putter structures that change the look and feel of the club are welcomed by at least some players. The present invention is provided to solve these and other problems and to provide advantages not provided by prior art putters.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to putters and putter heads that may include a putter head body having a cavity formed therein. The cavity may be configured to receive an adjustable ball striking face insert. The adjustable ball striking face insert may have a plurality of sides and, in some arrangements, each of the sides may have different performance characteristics in order to provide customization to the putter.

The adjustable ball striking face insert may, in some examples, be contained within the putter head. For instance, one side of the adjustable ball striking face insert may be arranged in substantial alignment with a front face of the putter and may form at least a portion of the ball striking surface. The remaining sides of the adjustable ball striking face insert may be contained with and/or enclosed within the putter body to minimize dirt, debris, moisture, etc. contacting the sides not in use. That is, the remaining sides (those not forming at least a portion of the ball striking surface) may not be visible from an exterior of the putter.

The adjustable ball striking face insert may be rotatably connected to the putter head to allow rotation of the insert within the cavity. In some arrangements, the putter head may be separable to aid in this rotation or generally in adjustment of the insert. Further, the insert may be finely adjusted (e.g., in small increments) to alter the loft angle of the putter in order to provide additional customization of the putter. Additionally or alternatively, the adjustable ball striking face insert may be removably connected to the putter head.

Additional aspects of this invention also relate to methods for making putters and putter heads, e.g., of the various types described above.

BRIEF DESCRIPTION OF THE DRAWINGS

A more complete understanding of the present invention and certain advantages thereof may be acquired by referring to the following detailed description in consideration with the accompanying drawings, in which like reference numbers indicate like features, and wherein.

DETAILED DESCRIPTION

Figure 1:
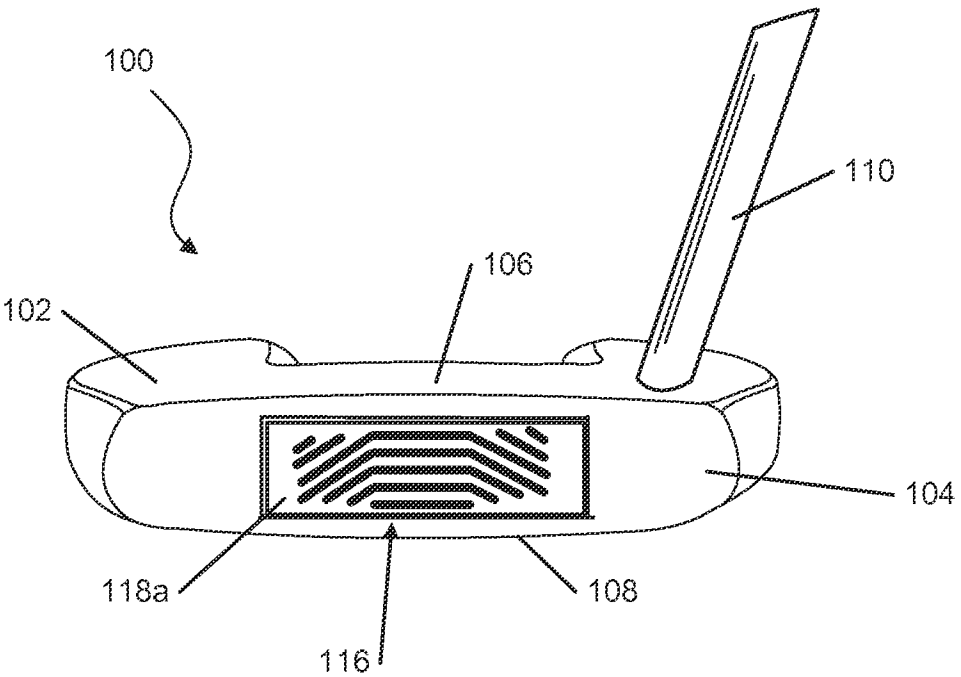
FIG. 1 illustrates one example putter head having an adjustable ball striking face insert in accordance with at least some aspects of this invention.

In the following description of various example putter heads and other aspects of this invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures and/or the orientations during typical use. Nothing in the specification or figures should be construed as requiring a specific three dimensional orientation of structures in order to fall within the scope of this invention.

At least some example aspects of this invention relate to putters and putter heads. A general description of aspects of the invention followed by a more detailed description of specific examples of the invention follows.

A. General Description of Putters and Putter Heads According to Aspects of the Invention In general, aspects of this invention relate to putters and putter heads. Such golf club heads, according to at least some examples of the invention, may include a golf club head body formed of two separable portions and including a cavity formed in the golf club head body. The golf club heads may further include an adjustable ball striking insert contained within the cavity and having at least four sides. In some examples, at least two of the at least four sides may have different performance characteristics. In some examples, each of the at least four sides may have different performance characteristics. The adjustable ball striking insert may be adjustable to permit each of the at least four sides to form at least a portion of a ball striking face of the golf club head. In some examples, the adjustable ball striking face insert may be contained within the cavity in the golf club head body such that one side of the insert may be exposed and form at least a portion of the ball striking surface while the remaining sides are enclosed within the golf club head.

In some examples, the adjustable ball striking face insert may be rotatably mounted within the golf club head body. Additionally or alternatively, the adjustable ball striking face insert may be removably mounted in the cavity of the golf club head body. In some arrangements, the golf club head may be connected to shaft, thereby forming a golf club.

Additional aspects of the invention may relate to putters and putter heads. Such putters and putter heads may include a putter head body having a front face and a cavity formed in at least a portion of the front face. In some examples, the cavity may extend reward, toward a center of the putter head body. The putters and putter heads may further include an adjustable ball striking face insert contained within the cavity formed in the putter head body. The adjustable ball striking face insert may have a plurality of sides, each of the sides having different performance characteristics and each of the sides being configured to form at least a portion of a ball striking surface in an in-use position. In some examples, the adjustable ball striking face insert may have two, three, four, five, six or more sides.

In some arrangements, the adjustable ball striking face insert may be mounted on an axle to permit rotation of the insert within the cavity. Additionally or alternatively, the insert may be removably connected to the putter head body. Further, in at least some examples, a first side of the adjustable ball striking face insert may form at least a portion of a ball striking surface, while the remaining sides of the insert may be contained within the putter head.

Still other aspects of the invention may relate to golf clubs and golf club heads that may include a shaft and a golf club head connected to a first end of the shaft. In some examples, the golf club head may include a cavity formed in at least a portion of a front face of the golf club head and extending rearward, toward a center of the golf club head/ The golf clubs and golf club heads may further include an adjustable ball striking face insert rotatably connected to the golf club head and contained within the cavity. In some arrangements, the adjustable ball striking face insert may have a plurality of sides, at least two of the sides having different performance characteristics and each of the sides being configured to form at least a portion of a ball striking surface of the golf club head in an in-use position. In some examples, the adjustable ball striking face portion may be further adjustable to alter a loft angle of the ball striking surface. For instance, the adjustable ball striking face insert may be finely rotatable to adjust the loft angle in increments between 1° and 5°.

Specific examples of the invention are described in more detail below. The reader should understand that these specific examples are set forth merely to illustrate examples of the invention, and they should not be construed as limiting the invention.

B. Specific Examples of The Invention

The various figures in this application illustrate examples of putters, components thereof, and methods in accordance with examples of this invention. When the same reference number appears in more than one drawing, that reference number is used consistently in this specification and the drawings to refer to the same or similar parts throughout.

FIG. 1 illustrates an example putter 100 in accordance with at least some aspects of this invention. The putter 100 includes a putter head 102 having a ball striking face 104, a top 106, a bottom 108, and a shaft 110 engaged with the putter head 102. The top 106 of the putter head 102 may include an alignment aid (not shown) having any desired shape, structure, etc. The putter head 102 may be made from any desired materials without departing from this invention, including, for example, metals, metal alloys, and the like, including materials that are conventionally known and used in the art. Likewise, the shaft 110 may be made of any desired materials without departing from this invention, including, for example, metals, metal alloys, composites, and the like, including materials that are conventionally known and used in the art. Additionally, the shaft 110 may be connected to the putter head 102 using one of any conventional methods of connection, including adhesives, fasteners, and the like.

The putter head 102 may include a recess or cavity (114 in FIG. 2) formed in the front face 104 of the putter head 102 and extending inward, toward a center of the putter head 102. The cavity 114 may be configured to receive an adjustable ball striking face insert (116 in FIG. 2). In some examples, the adjustable ball striking face insert 116 may be removable and/or interchangeable with other adjustable ball striking face inserts, as will be discussed more fully below. The adjustable ball striking face insert 116 may form at least a portion of the ball striking face 104 of the putter head 102 and may have multiple sides that each may form a portion of the ball striking face 104 when arranged in an in-use position. For instance, the adjustable ball striking face insert 116 may have two, three, four, five, six or more sides that may each, in some arrangements, form at least a portion of the ball striking face 104 when in an in-use position (e.g., aligned with the ball striking face 104). The adjustable ball striking face insert may be formed using known manufacturing methods including molding, rapid manufacturing additive fabrication techniques, and the like. Additionally or alternatively, one or more sides of the insert 116 may be integrally formed as a single piece, or may be formed separately and joined using known methods of joining such as adhesives, mechanical fasteners, snap fits, and the like.

The adjustable ball striking face insert 116 may be sized to fit within the putter head and may vary in width across the face of the putter head 102. For instance, the insert 116 may be between 1 and 4 inches wide, 1 and 4 inches high and 1 and 4 inches deep. Additionally or alternatively, the insert 116 may comprise between 5% and 80% of the face 104 of the putter head 102.

Figure 2:
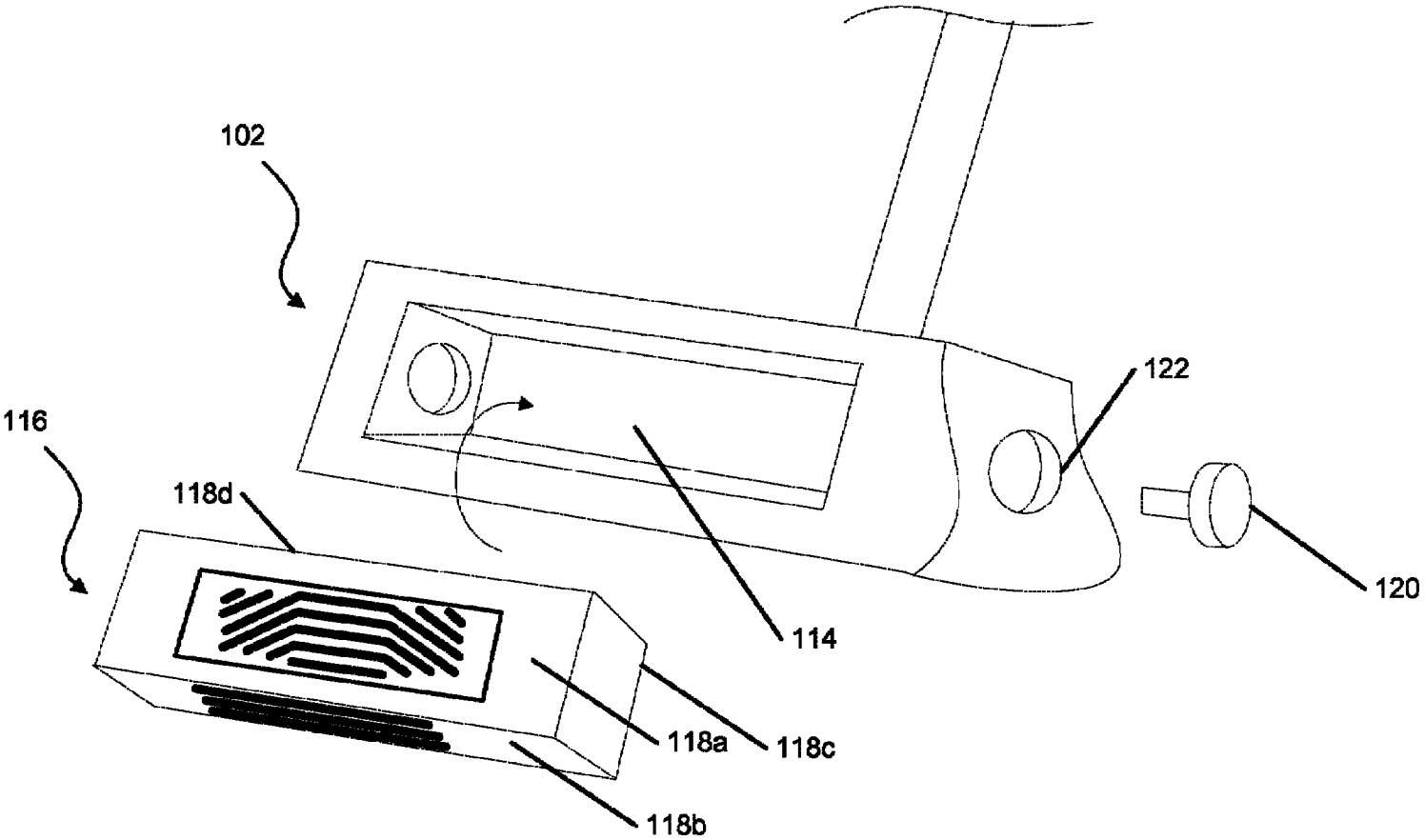
FIG. 2 is a perspective view of the putter head of FIG. 1 with the adjustable ball striking face insert removed to illustrate the shape of the insert and a cavity formed in the putter head in accordance with at least some examples of this invention.

The arrangement of FIGS. 1 and 2 illustrates a four-sided adjustable ball striking face insert 116 that may have a substantially square or rectangular cross section. One or more sides of the adjustable ball striking face insert 116 may include a ball striking face portion having performance characteristics different from another side of the insert 116. In some examples, each side of the insert 116 may have a ball striking face portion having performance characteristics different from the other sides of the insert 116, as will be discussed more fully below.

The adjustable ball striking face insert 116 may be arranged within the cavity 114 such that one side of the adjustable ball striking face insert 116, such as side 118*a*, may form at least a portion of the ball striking surface 104, while the remaining sides (118*b*-1118*d* in FIG. 2) may be enclosed by or encased within, the putter head 102. The unexposed sides of the adjustable ball striking face insert 116 may be contained within the putter head 102 to prevent dirt, debris, moisture, etc. from contacting the unexposed sides 118*a*-118*d* of the insert 116. Additionally or alternatively, the unexposed sides 118*a*-118*d* of the insert 116 may be contained within the putter head 102 to avoid any pattern or other visual marker arranged on the unexposed sides 118*a*-118*d* from providing a distraction during a putting stroke. For instance, various material patterns, colors, etc. may appear on one or more sides 118*a*-118*d* of the insert 116. These patterns may affect alignment of the putter 100 and/or the stroke of the putter 100 by acting as a visual distraction to the golfer. Containing the unexposed sides reduces the effects of this potential distraction.

The adjustable ball striking face insert 116 may be adjustably contained within the cavity 114 in the putter head 102. In some examples, the adjustable ball striking face insert 116 may be mounted on an axle (as will be discussed more fully below) extending through the insert 116 and into the putter head 102 that may permit rotation of the insert 116 within the putter head 102. In other arrangements, the adjustable ball striking face insert 116 may be removably contained within the cavity 114 in the putter head 102 using, for instance, set screws or other fasteners 120 extending through the putter head 102 (such as through aperture 122) and contacting or extending into the insert 116. These screws or other fasteners 120 may hold the insert 116 in a desired position with one of the sides or faces 118*a*-118*d* forming at least a portion of the ball striking face 104. That is, a user may remove the insert 116 from the cavity 114, select a desired side 118*a*-118*d* of the adjustable ball striking face insert 116 that will form a portion of the ball striking face 104 and may return the insert 116 to the cavity 114 with the desired face or side 118*a*-118*d* forming the portion of the ball striking face 104. The screws or other fasteners 120 may then be tightened to maintain the position of the adjustable ball striking face insert 116 within the cavity 114.

FIG. 2 is a perspective view of the putter head 102 of FIG. 1 with the adjustable ball striking face insert 116 removed. The cavity 114 in the putter head 102 is clearly visible and is shown having a shape generally corresponding to the shape of the adjustable ball striking face insert 116. The insert 116 is shown as having four sides 118*a*-118*d*. However, as mentioned above, the adjustable ball striking insert 116 may have between two and six sides or faces that may each form at least a portion of the ball striking face 104 when in an in-use position (e.g., when aligned with the ball striking face 104). In some arrangements, one or more of the sides or faces 118*a*-118*d* of the adjustable ball striking face insert 116 may have different performance characteristics from at least one other side 118*a*-118*d* of the insert 116 in order to permit at least some customization of the putter 100. In some examples, each side 118*a*-118*d* of the adjustable ball striking face insert 116 may have performance characteristics that differ from each of the other sides 118*a*-118*d* of the insert 116. Thus, a user may select the desired side 118*a*-118*d* based on the performance characteristics desired and may adjust the insert 116 such that the desired face or side 118*a*-118*d* forms a portion of the ball striking surface 104. Accordingly, the remaining sides 118*a*-118*d* may be contained within or enclosed by the putter head 102 in order to prevent debris, dirt, moisture, etc. from building up on the sides 118*a*-118*d*.

Figure 3:
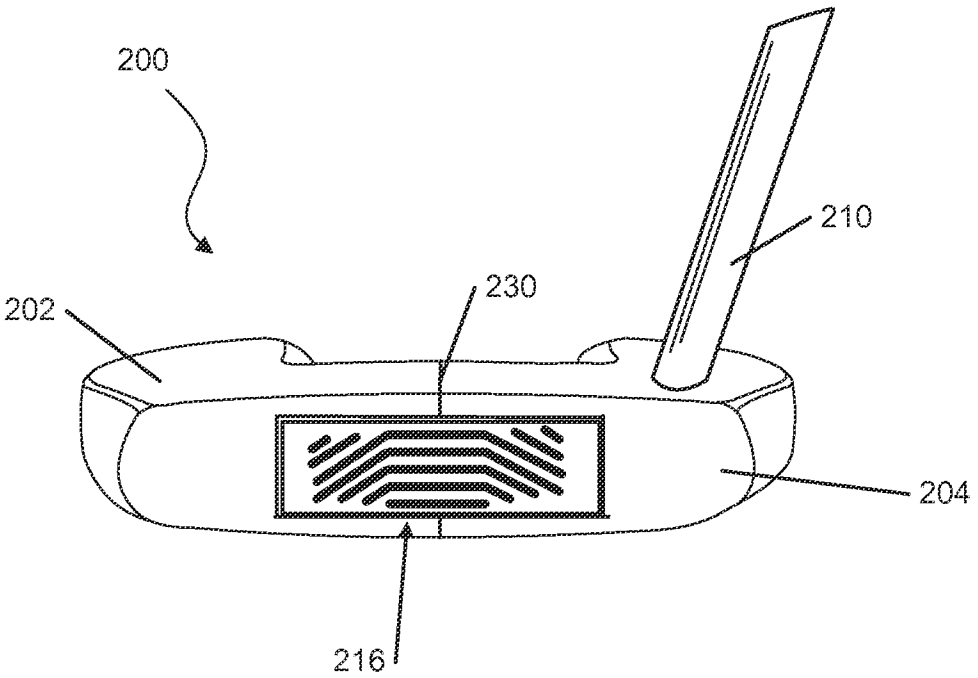
FIG. 3 illustrates an alternate arrangement of a putter head having an adjustable ball striking face insert in accordance with at least some aspects of this invention.
Figure 4:
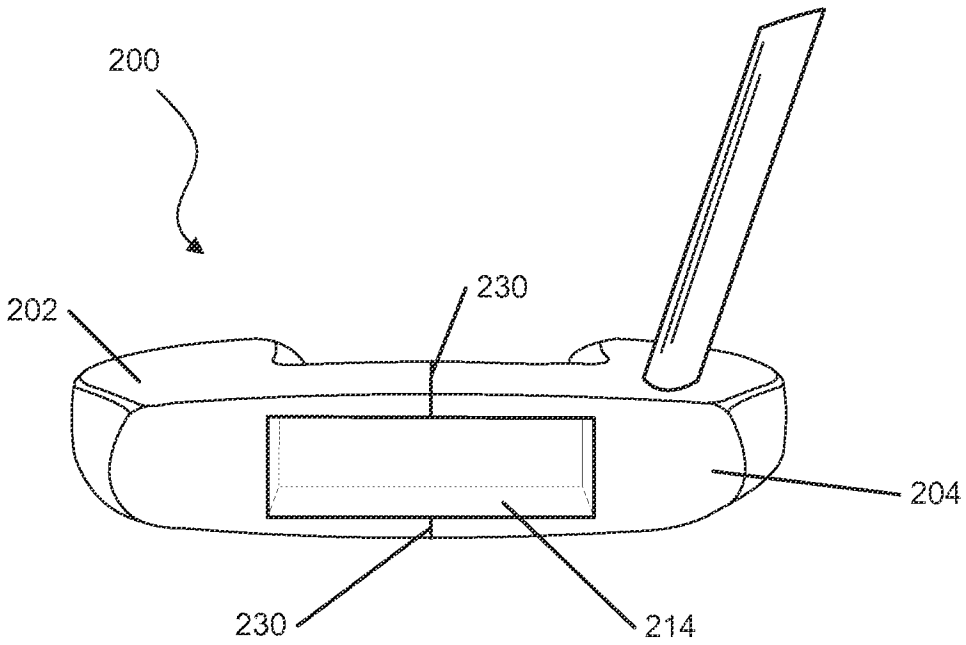
FIG. 4 is a front view of the putter head of FIG. 3 with the adjustable ball striking face insert removed to show a cavity formed in the putter head in accordance with at least some aspects of this invention.
Figure 5A:
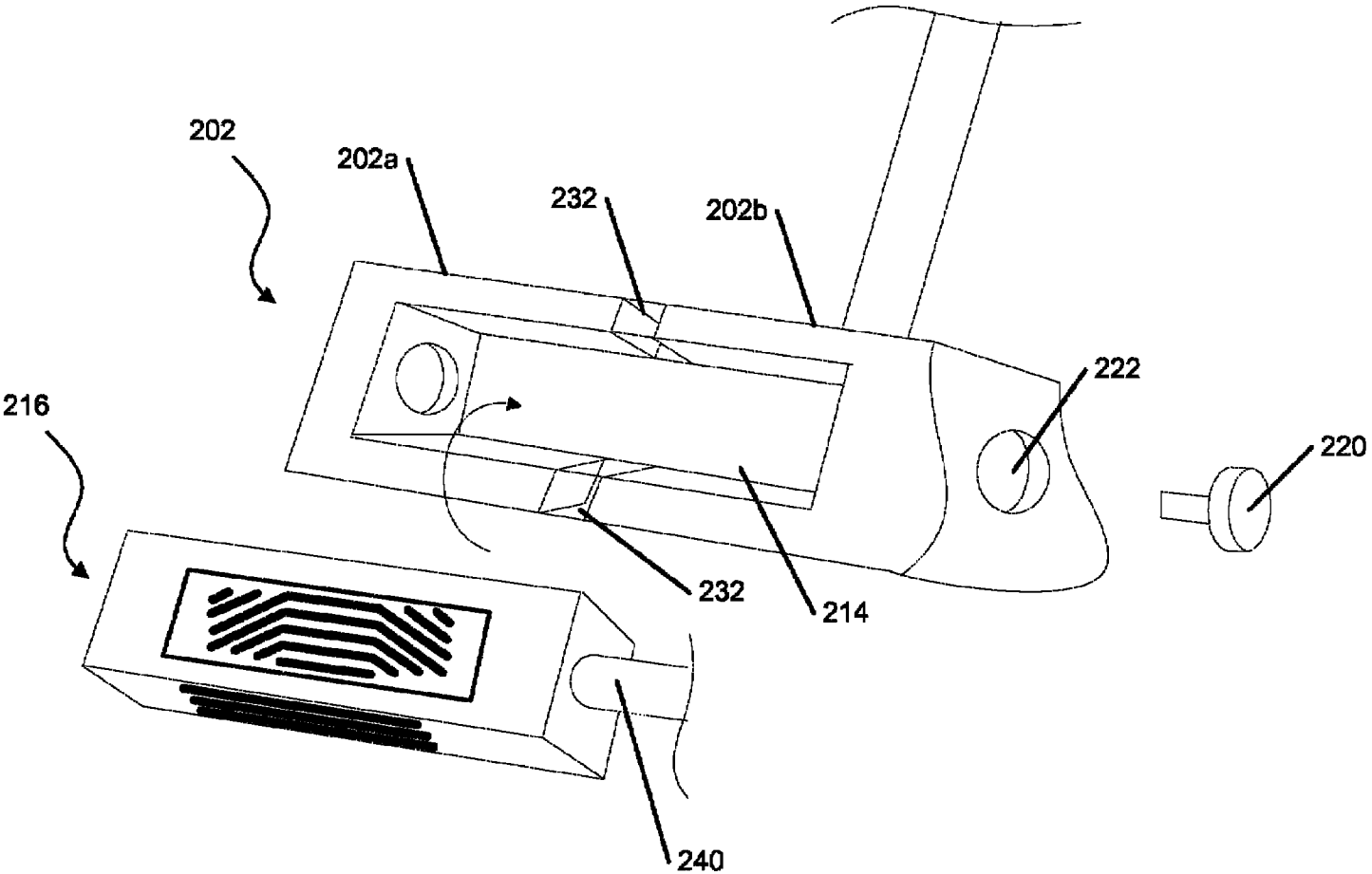
FIG. 5A is a perspective view of the putter head of FIG. 3 with the adjustable ball striking face insert removed to illustrate the shape of the insert and cavity formed in the putter head in accordance with at least some aspects of this invention.

FIGS. 3-5 illustrate another example putter 200 having an adjustable ball striking face insert 216. Similar to the arrangement of FIGS. 1 and 2, the putter 200 includes a putter head 202 having a shaft 210 connected to the putter head 202. The putter head 202 may further include a ball striking surface 204 configured to contact the ball during a putting stroke. The ball striking surface 204 may include at least a portion formed by the adjustable ball striking face insert 216. The putter head 202 may further include a cavity 214 extending inward, toward a central region of the putter head 202. The cavity 214 may be configured to receive the adjustable ball striking face insert 216. Although the arrangements of FIGS. 3-5 illustrate a four-sided adjustable ball striking face insert 216, an insert having any number of sides (2, 3, 5, 6, etc. as discussed above) may be used in accordance with the arrangements described herein.

As shown in FIGS. 3-5C, the putter head 202 may, in some arrangements, be separable. For instance, seam 230 indicates a break in the putter head 202. In some examples, screws or other fasteners, such as fastener 220, may be used to maintain the position of the insert 216 within the cavity 214 and may also connect the separable portions of the putter head 202 to each other. Accordingly, the screw 220 may be loosened and the putter head 202 may separate, as shown in FIG. 5A. In some examples, each portion of the putter head 202*a*, 202*b* may slide outward. The portions 202*a*, 202*b* may remain connected to each other, such as by a frame or other support structure, in order to aid in ease of adjustment of the insert 116, reconnection of the putter head portions 202*a*, 202*b*, etc. Alternatively, the portions 202*a*, 202*b* of the putter head 202 may separate completely such that each portion 202*a*, 202*b* may be unconnected to the other portion 202*a*, 202*b* upon separation.

Separation of the two putter head portions 202*a*, 202*b* may provide a gap 232, which will aid in movement and adjustment of the adjustable ball striking face insert 216. For instance, as mentioned above, the insert 216 may be mounted on an axle 240 that may extend through the insert 216 and, in some examples, into the putter head 202. The axle 240 may permit rotation of the insert 216 about the axle 240 when the putter head portions 202*a*, 202*b* are separated. That is, the insert 216 may be rotated about the axle 240 until a desired side or face 218*a*-218*d* of the insert is in the in-use position (e.g., aligned with the ball striking surface 204) and forms at least a portion of the ball striking face 204. When the desired side 218*a*-218*d* is arranged with the ball striking face 204, the portions 202*a*, 202*b* may slide together, or otherwise rejoin, and any fasteners or other connection mechanisms (such as screws, bolts, etc.) may be fastened in order to maintain the position of the insert 216 within the cavity 214 and, in some examples to join the putter head portions 202*a*, 202*b*. In arrangements in which the insert 216 is mounted on an axle 240, the insert 216 may or may not be removable from the putter head 202.

Alternatively, the adjustable ball striking face insert 216 may be removably mounted within the cavity 214 of the putter head 202, such as with screws, bolts, mechanical fasteners, etc. as discussed above. Removability of the adjustable ball striking face insert 216 may permit interchangeability of the insert 216 with another insert having, perhaps, sides offering alternative performance characteristics to those of insert 216. The availability of these additional performance characteristics provides further customization options for a user.

Figure 5B:
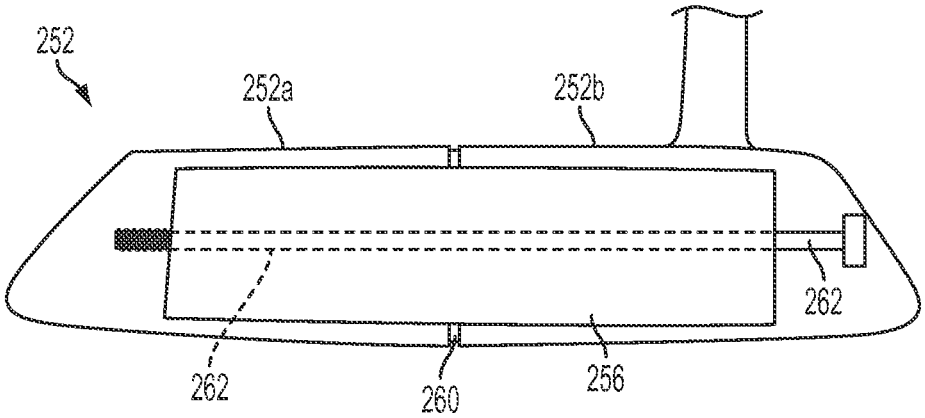
FIGS. 5B and 5C are front and exploded views, respectively, of another putter head arrangement having an adjustable ball striking face insert in accordance with at least some aspects of the invention.
Figure 5C:
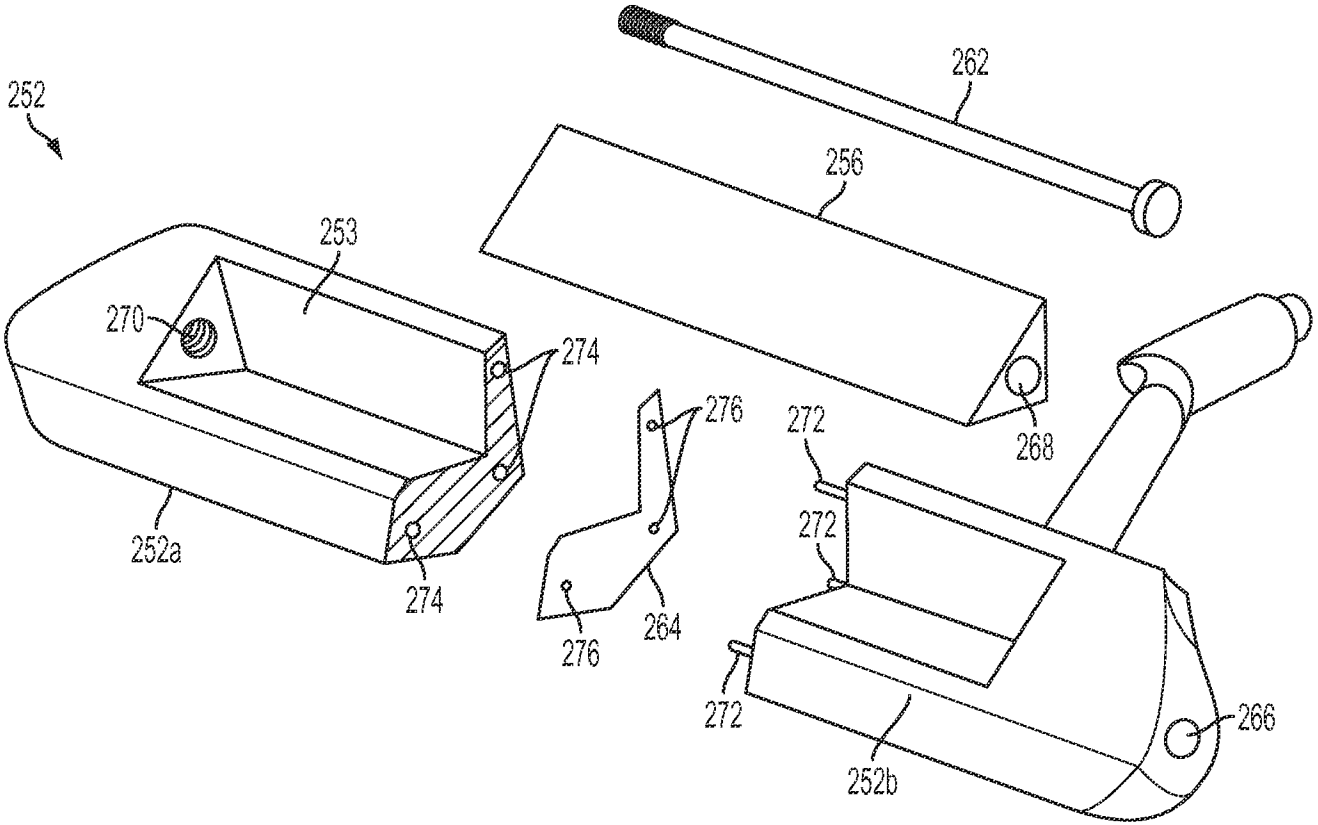

FIGS. 5B and 5C illustrate yet another putter arrangement having an adjustable ball striking face insert. FIG. 5B is a front view of the putter and, similar to the arrangement of FIG. 5A, the putter head 252, may be separable into two putter head portions, 252*a* and 252*b*. The putter head 252 may also include an adjustable ball striking face insert 256, similar to the arrangements discussed above that may fit into recess 253 (FIG. 5C). As shown in FIG. 5C, the ball striking face insert 256 may be generally three sided (i.e., having a substantially triangular cross section). However, as discussed above, various other shapes, cross sections, etc. may be used without departing from the invention, such as four sided, five sided, six sided, etc.

Figure 9:
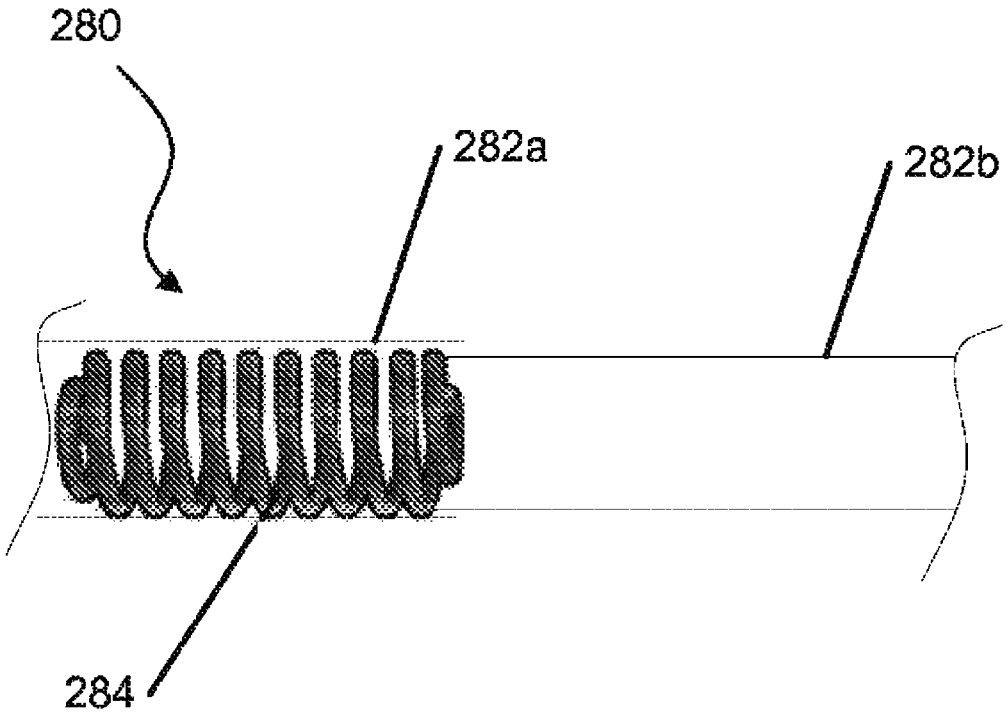
FIG. 9 is an example two-part rod arrangement that may be used to secure the adjustable ball striking face insert within a putter head in accordance with at least some aspects of the invention.

With further reference to FIG. 5B, the putter head 252 may include a seam or split 260. The putter head portions 252*a* and 252*b* may separate along the seam 260 in order to permit rotation or adjustment of the adjustable ball striking face insert 256. The putter head 252 may also include an axle, such as pin 262. The pin 262 may, in some examples, be a locking pin or other device configured to maintain the position of the insert 256 within the putter head 252. In some examples, such as shown in FIG. 9, the axle may be a two-part rod 280 having a hollow core. The two-part rod 280 may include multiple portions 282*a* and 282*b* and may be telescoping (e.g., one end of one portion may fit into the hollow core of an end of the other portion). In some examples, a spring 284 may be arranged within the hollow core. In this arrangement, the two-part rod 280 may extend through the putter head 252 and through the insert 256 (similar to the arrangement shown in FIG. 5B) and screws may be used to secure the two-part rod within the putter head 252. For instance, the screws may be arranged at one or more ends of the two-part rod and may tighten the rod within the insert 256 and putter head 252 by compressing the spring within the two-part rod in order to maintain the position of the insert 256 within the putter head 252.

FIG. 5C illustrates the putter head 252 in an exploded view. As shown, the putter head portions 252*a* and 252*b* are shown separated and the insert 256 is shown outside of the putter head 252. In some examples, a gasket 264 may be positioned between each portion of the putter head 252 in order to aid in sealing the putter head portions 252*a* and 252*b* together. In some examples, the gasket 264 may also provide a sight line along the putter head 252 (e.g., along a top surface of the putter head) in order to aid in alignment of the putter during a putter stroke.

The axle 262 is also shown in FIG. 5C. As discussed above, the axle may be a locking pin and may having a hex nut or other fastener arranged on one or both ends. The fastener may be used to tighten the locking pin 262 within the putter head 252 and aid in maintaining the position of the insert 256 within the putter head 252. The locking pin or axle 262 may be inserted into the putter head 252 through aperture 266 located in an end portion (either a heel or toe) of the putter head 252. The axle 262 may extend through an aperture in the insert 256, such as aperture 268, and may screw into recess 270 formed in an opposite end of the putter head 252. The recess may be threaded to receive the locking pin 262.

In some arrangements, each putter head portion 252*a* and 252*b* may include one or more locating pins and/or locating pin holes. For instance, as shown in FIG. 5C, putter head portion 252*b* includes a plurality of locating pins 272 protruding from an inner surface of the portion 252*b*. The locating pins 272 may aid in alignment of the putter head portions 252*a* and 252*b* during reassembly by mating with corresponding locating pin holes or recesses, such as locating pin holes 274 formed in putter head portion 252*a*. In arrangements in which a gasket 264 is included between the putter head portions 252*a* and 252*b*, the gasket 264 may include apertures 276 corresponding to the position of the locating pins 272 through which the locating pins 272 may pass during assembly. The locating pins 272 may also aid in maintaining the position of the gasket 264 and in ease of assembly.

Similar to the arrangements described above, the putter head 252 may be separated by loosening the fastener (e.g., hex nut positioned at end of locking pin, screw at end of two-part rod, etc.) and pulling the two putter head portions

252*a* and 252*b* apart. This separation may allow for rotation of the insert 256 to change the side of the adjustable ball striking insert 256 that will form a portion of the ball striking surface. As discussed above, the different sides of the insert 256 may, in some instances, have different performance characteristics.

Figure 6:
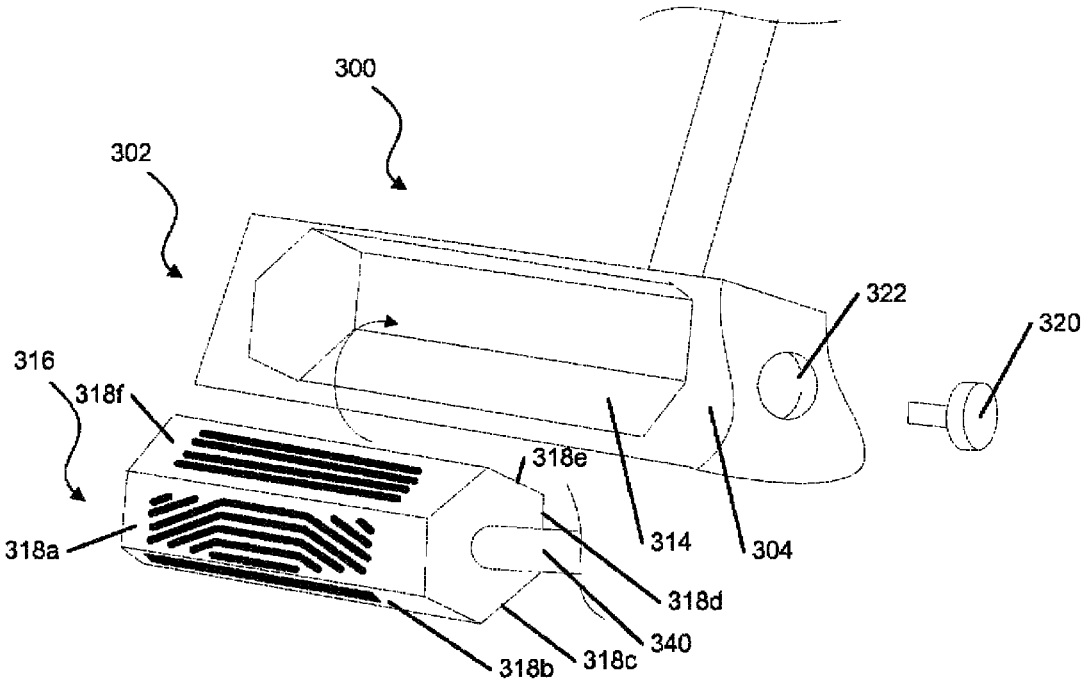
FIG. 6 is yet another arrangement of a putter head having an adjustable ball striking face insert in accordance with at least some aspects of this invention.

FIG. 6 illustrates yet another putter 300 having an adjustable ball striking face insert 316. As shown, the adjustable ball striking face insert is generally hexagonal, and the corresponding cavity 314 formed in the putter head 302 is generally shaped to correspond to the hexagonal insert 316. The putter 300 may be a single piece (similar to the arrangement of FIGS. 1 and 2) or may be separable into one or more portions (similar to the arrangement of FIGS. 3-5). Further, the insert 316 may be mounted on an axle 340 and rotatably mounted within the cavity 314 of the putter head 302. The axle 340 and/or insert 316 may be held in place via screws 320 or other fasteners, as discussed above.

The adjustable ball striking face insert 316 is shown as having six sides. In some arrangements, one or more of the sides 318*a*-318*f* of the insert 316 may have different performance characteristics. Accordingly, the insert 316 may provide up to six different ball striking surfaces for the putter 300. In some examples, each of the sides 318*a*-318*f* may have different performance characteristics, such as different materials, combination of materials, hardness of materials, etc. For instance, the sides 318*a*-318*f* may include one or more materials of varying hardnesses, groove arrangements, etc. that may impart different roll characteristics to the ball, provide different feels for the user during a putt, etc. The side 318*a*-318*f* forming the ball striking face 304 may be selected by a user for the particular performance characteristics. In some examples, a user may different sides 318*a*-318*f* for different putts within the same round of golf depending on the conditions. Alternatively, a user may select a face or side 318*a*-318*f* having desired performance characteristics and may use that as the ball striking surface 304 for several putts or for all putts. Various combinations of performance characteristics, etc. may be used with the insert without departing from the invention.

For instance, one face or side 318*a*-318*f* of the insert 316 may be formed of one material or type of material, such as a traditional metal putter, etc. Additionally or alternatively, one or more sides 318*a*-318*f* may having multiple materials used in combination, such as materials of different hardnesses (polymer, metal, etc.). For instance, the putter may have a region formed of a soft polymer material to provide a softer feel. In still other examples, one or more of the sides 318*a*-318*f* may include scorelines formed in grooves on the ball striking surface of the insert. Various combinations of these material, designs, arrangements, etc. may be used on one or more sides of the insert 316 in order to provide a customizable putter 300 and enhance performance for the user.

FIGS. 7A-7D illustrate some example sides of an adjustable ball striking face insert, such as inserts 116, 216, 316 described above. The arrangements shown in FIGS. 7A-7D are simply a few examples of various ball striking face configurations. Nothing in the application should be construed as limiting the invention to only those ball striking face configurations discussed herein. Rather, the adjustable ball striking face insert may have multiple faces having various ball striking face arrangements formed from various types of materials, multiple materials, and the like.

Figure 7A:
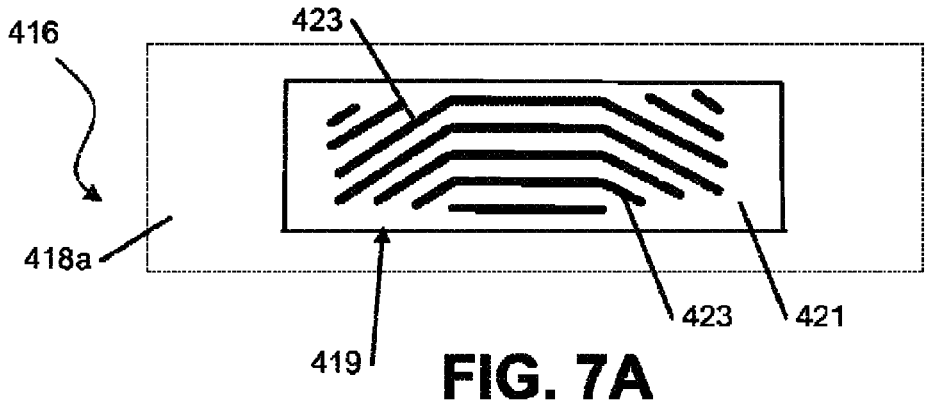
FIGS. 7A-7D illustrate some example adjustable ball striking insert face arrangements providing different performance characteristics in accordance with at least some aspects of this invention.

FIG. 7A is an example side 418*a* of an adjustable ball striking face insert 416. In the arrangement shown, the first side 418*a*, when exposed on the front face of the putter head in an in-use position, may form at least a portion of the ball striking face of the putter, as discussed above. The first side 418*a* may include a ball striking region 419. In some examples, the ball striking region 419 may include one or more portions formed of different materials. For instance, the main portion of the ball striking region may be formed of a metal, or other hard material and may, as shown in FIG. 7A, have grooves 423 formed in the metal portion 421. The grooves may be of various sizes, configurations, shapes, etc. and may be machined or otherwise formed in the metal portion 421. The grooves 423 may have a constant depth, width, height, etc. across the plate side of the insert 418*a*. However, in some examples, the depth, width, height, etc. of one or more grooves 423 may vary along the length of the groove 423, along the plate side 418*a*, and the like. Additionally or alternatively, the grooves 423, or a portion thereof, may be arranged generally horizontally across the face of the insert 416 when the putter is in a ball address position. In other arrangements, the grooves 423 may extend in a non-horizontal linear, circular, semi-circular, or other curved pattern on the face, as will be discussed more fully below.

The metal portion 421 of the ball striking region 419 may also include a material filling the grooves 423. For instance, in some examples, a material softer than the metal material may fill the grooves 423 in order to provide a softer feel for the putter. For instance, the grooves may be filled with a polymer material, such as thermoplastic polyurethane or a thermoset material. In some examples, the polymer material filling the grooves may have a hardness range between 25 and 85 Shore D. In some specific examples, the polymer material filling the grooves 423 may have a hardness range between 35 and 45 Shore D, 50 and 60 Shore D or 60 and 70 Shore D. The polymer material may be lighter than the metal, thereby reducing weight associated with the putter head. Additionally, by including this relatively soft polymeric material as part of the ball striking face (such that the polymeric material also directly contacts the ball during a putt), the ball strike characteristics of the putter head may be altered and controlled, which affects the sound, rebound, and other "feel" characteristics of the putter head (e.g., by damping vibrations and altering the sound of a ball strike). The polymeric material also may influence ball spin as the ball comes off the putter face. These features also will be described in more detail below.

The insert 416, or portions thereof, may be formed of any suitable material. For instance, the insert 416 and, in FIG. 7A, the metal portion 421, may be formed of various materials, including metals such as aluminum, steel, titanium, nickel, beryllium, copper, combinations or alloys including these metals, and the like. This combination of metal and polymer materials on the ball striking face may provide improved performance of the golf club including softer feel, increased spin rate, more true roll, a more metallic ball striking sound, etc.

In some examples, the polymer material may include scorelines formed therein. The scorelines may be formed in the polymer material during molding or other fabrication of the insert or, optionally, if desired, some portion of the scorelines may be cut into the polymer or metal portion of the grooves 423.

In some examples, the ball striking region 419 may include a removable insert that may allow further customization/personalization of the putter. For instance, one or more sides of the insert may include a removable ball striking region that may be interchanged with other removable ball striking regions to provide even more options for varying the performance characteristics of the putter. Personalization and customization features may include various characteristics such as polymer and/or metal color (e.g., team colors, color associated with a cause or promotion, player preference, etc.); polymer and/or metal hardness (e.g., harder or softer for different play conditions or swing types); graphics on the polymer and/or metal (e.g., logos, etc.); etc.

Although the arrangement of FIG. 7A has been described as having a metal portion forming a substantial portion of the ball striking region 419, the metal may, in some examples, be replaced by a polymer material of a different hardness than the polymer material filling the grooves. For instance, the metal portion 421 may be replaced with a polymer material having a higher Shore hardness value than the polymer filling the grooves 423. This all polymer arrangement may aid in further reducing weight associated with the golf club head. Additionally or alternatively, the polymer material filling the grooves may be replaced with a metal of a different hardness from the original metal, thereby forming an insert of all metal.

Figure 7B:
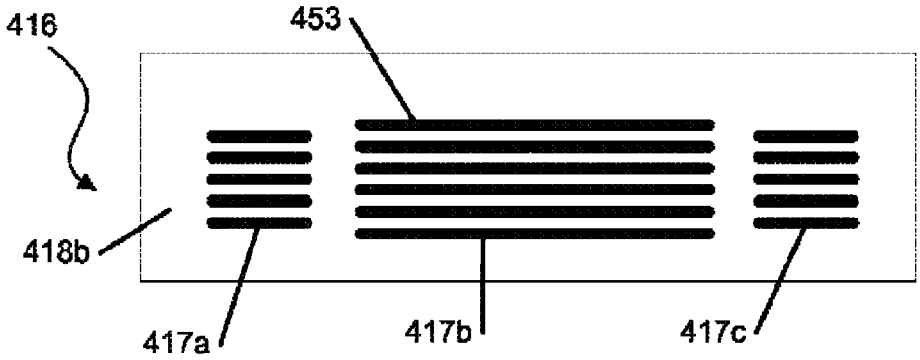

The ball striking region 419 of FIG. 7A includes grooves having portions extending generally horizontally across the side 418*a* of the insert 416 and portions extending at an angle, downward on the side 418*a*. The angled portions may be arranged at any suitable angle and the number of grooves formed in the side 418*a* may be more or fewer than those shown. Alternatively, FIG. 7B provides another arrangement in which a series of generally horizontal grooves are formed across the side 418*b* in three groups, 417*a*-417*c*. Similar to the arrangement of FIG. 7A, the side 418*b* may be formed substantially of metal with grooves 453 formed therein. The grooves 453 may be filled with a polymer material. Alternatively, the side 418*b* may be formed substantially of a polymer material and have grooves 453 filled with a metal or other hard material to provide a harder feel during use than the arrangement of FIG. 7A. These differing groove arrangements may alter the roll of the ball during a putting stroke, the feel of a putter, etc.

Figure 7C:
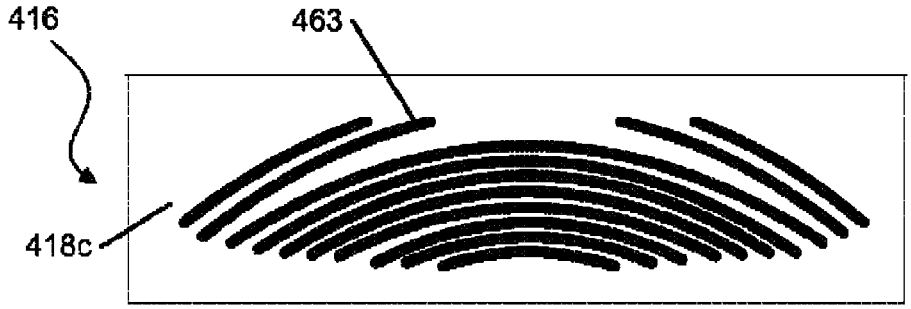

FIG. 7C illustrates yet another example side surface arrangement for an adjustable ball striking face insert 416. The side 418*c* includes a plurality of grooves formed in the side 418*c* in a semicircular pattern. Similar to the arrangement of FIG. 7A, the side 418*c* may be formed of a first material and may have grooves 463 formed therein and filled with a second, different material.

Figure 7D:
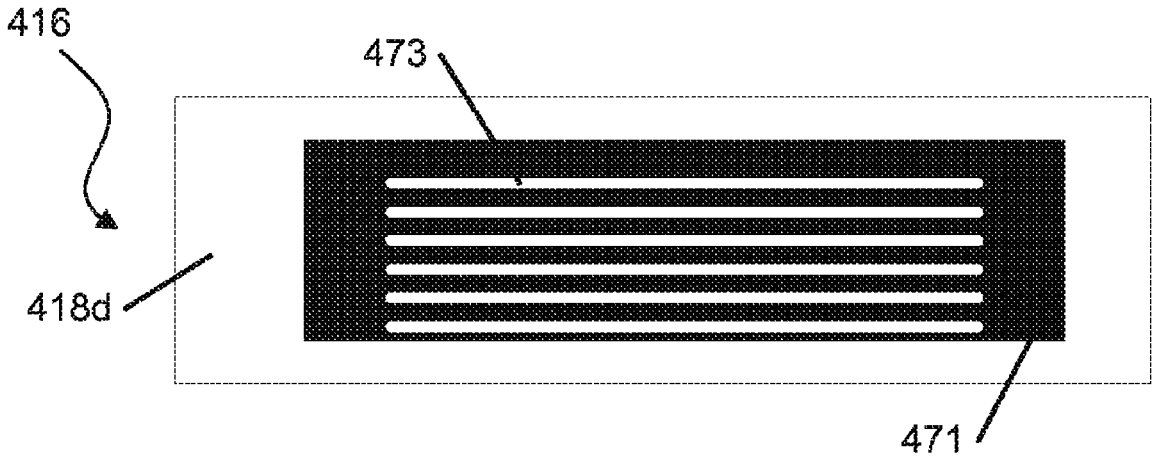

FIG. 7D illustrates yet another example arrangement for a side 418*d* of the insert 416. The arrangement shown indicates a majority of the ball striking region 419 being formed of a polymer material and having grooves 473 formed therein. The grooves 473 may be filled with a material different from the polymer material or may be formed of another polymer material having a different hardness from the polymer material forming the main portion of the ball striking region.

As mentioned above, the arrangements shown in FIGS. 7A-7D are merely a few examples of different arrangements for one or more sides of the adjustable ball striking face insert that may provide different performance characteristics. Nothing in this disclosure should be construed as limiting the insert to only these arrangements. Rather, any ball striking face arrangement, including different materials, combinations of materials, groove patterns, depths, sizes, etc. may be used with the adjustable ball striking face insert without departing from the invention. Additional putter face arrangements are described in U.S. patent application Ser. No. 12/612,236, filed Nov. 4, 2009 and entitled "Putter Heads and Putters Including Polymeric Material as Part of the Ball Striking Face," which is incorporated herein by reference.

Figure 8A:
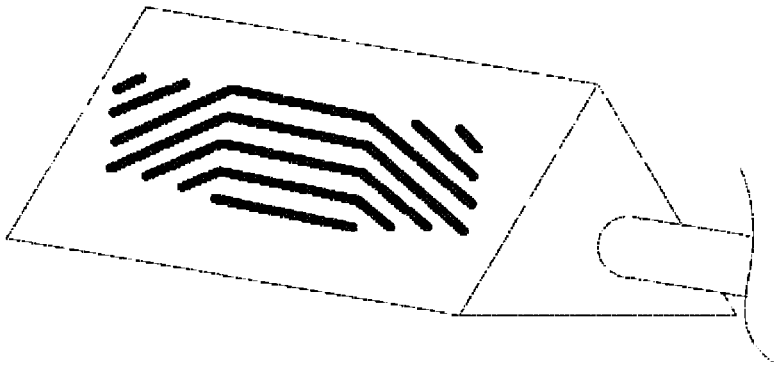
FIGS. 8A and 8B are example alternate configurations of adjustable ball striking face inserts having three and five sides, respectively, in accordance with at least some aspects of this invention.
Figure 8B:
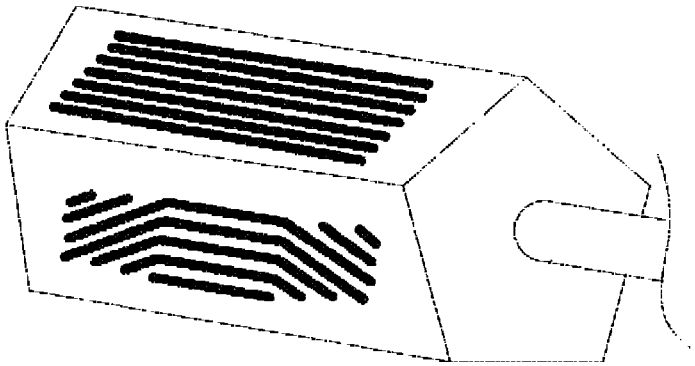

FIGS. 8A and 8B illustrate some additional insert shapes that may be used in accordance with aspects of this invention. FIG. 8A illustrates a three-sided or triangular insert that may provide up to three different ball striking surface configurations. FIG. 8B illustrates a five-sided or pentagonal arrangement having up to five different ball striking surface arrangements. Additional or alternative ball striking face arrangements may be used with any of the inserts described herein and nothing in the specification or figures should be viewed as limiting the face arrangements to only those shown and described.

In some arrangements, the adjustable ball striking face insert may be adjusted in small increments in order to adjust the loft angle of the putter and ball striking surface. For instance, and with further reference to FIG. 6, the set screw 320 or other fastener, may allow for fine adjustments in the position of the insert 316 within the cavity 314. That is, the insert 316 may be adjusted slightly up or down to increase or decrease the loft angle of the ball striking surface 314. In some examples, the insert 316 may be infinitely rotatable to provide any number of positions and associated loft angles. Additionally or alternatively, the rotation may be at predefined increments or may include stops which may provide a finite number of positions of the insert 316 within the cavity 314. In some examples, the adjustable ball striking face insert may be adjustable in increments between 0° and 6°.

Aspects of this invention may be practiced with any desired putter head construction without departing from this invention. FIGS. 1-6 illustrate aspects of the invention included in various mallet type golf putter head structures. However, aspects of this invention also may be practiced with blade type putter heads, high moment of inertia, large size putter head construction, etc.

Putters and putter heads may have any desired constructions, materials, dimensions, loft angles, lie angles, colors, designs, and the like without departing from this invention, including conventional constructions, materials, dimensions, loft angles, lie angles, colors, designs, and the like, as are known and used in the art.

Conclusion

Of course, many modifications to the putter and putter head structures and/or methods for making these structures may be used without departing from the invention. For example, with respect to the structures, grips, aiming indicia or markings, other indicia or markings, different types of putter heads, various shaft curvatures and/or shapes, various shaft connecting member shapes, and/or other structural elements may be provided and/or modified in the structure without departing from the invention. With respect to the methods, additional production steps may be added, various described steps may be omitted, the steps may be changed and/or changed in order, and the like, without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

We claim:

1. A golf club head, comprising:

a golf club head body formed of two separable portions, a toe portion and a heel portion, and including a cavity formed therein;

an adjustable ball striking insert contained within the cavity and having at least four sides, at least two of the at least four sides having different groove patterns, the adjustable ball striking insert being adjustable to permit each of the at least four sides to form a ball striking face of the golf club head;

wherein the cavity is enclosed on three sides; and wherein one of the at least four sides of the adjustable ball striking insert forms at least a portion of the ball striking face of the golf club head and the at least three remaining sides of the adjustable ball striking insert are enclosed within the golf club head.

2. The golf club head of claim 1, wherein each of the four sides of the adjustable ball striking insert have different groove patterns.

3. The golf club head of claim 1, wherein the adjustable ball striking insert is removably mounted in the cavity.

4. The golf club head of claim 1, wherein the golf club head body is separable along a centerline of the golf club head.

5. The putter head of claim 1, wherein the adjustable ball striking face insert has at least three sides.

6. The putter head of claim 1, wherein the adjustable ball striking face insert has a substantially square cross section.

7. The golf club of claim 1, wherein one or more of the sides have groove patterns comprising grooves arranged generally horizontally across the side.

8. The golf club head of claim 1, wherein one or more of the sides have groove patterns comprising grooves extending in a non-horizontal linear or in a curved pattern across the side.

9. The golf club head of claim 1, wherein one or more of the sides comprises groove patterns comprising grooves having portions extending generally horizontally across the side and portions extending at an angle downward on the side.

10. The golf club head of claim 1, wherein one or more of the sides comprise grooves filled with a polymer material.

11. The golf club head of claim 1, wherein a gasket is positioned between each portion of the golf club head body.

12. The golf club head of claim 1, wherein a single fastening device located in an end portion of the club head body secures the insert and the two separable portions.

13. The golf club head of claim 1, wherein one of the two separable portions of the club head body includes at least one locating pin and the other separable portion includes a corresponding locating pin hole.

14. A golf club, comprising:

a shaft;

a golf club head connected to a first end of the shaft, the golf club head including:

a golf club head body formed of two separable portions, a toe portion and a heel portion;

a cavity formed in at least a portion of a front face of the golf club head and extending rearward, toward a center of the golf club head;

an adjustable ball striking face insert contained within the cavity, the adjustable ball striking face insert having a plurality of sides, at least two of the sides having different groove patterns and each of the sides being configured to form at least a portion of a ball striking surface of the golf club head in an in-use position, the adjustable ball striking face portion being further adjustable to alter a loft angle of the ball striking surface; and wherein a first side of the plurality of sides of the adjustable ball striking face insert forms at least a portion of the ball striking surface and remaining sides of the plurality of sides are contained within the cavity of the golf club head.

15. The golf club of claim 14, wherein the adjustable ball striking face insert is rotatable to adjust the loft angle in increments between 0° and 6°.

16. The golf club of claim 14, wherein the adjustable ball striking face insert has at least four sides.

17. The golf club of claim 14, wherein the adjustable ball striking face insert is removably connected to the golf club head.

18. A golf club head, comprising:

a club head body formed of two separable portions, a toe portion and a heel portion, forming a top surface, a back surface, and a front surface;

a cavity formed in the club head body, the cavity extending from the front surface of the club head body, inward toward a center of the club head body;

an adjustable ball striking insert contained within the cavity and having at least four sides, at least two of the at least four sides having different groove patterns, a first side of the adjustable ball striking insert forming at least a portion of the ball striking surface of the golf club head and the top surface of the club head body extending over remaining sides of the adjustable ball striking insert obstructing a view of the remaining sides of the adjustable ball striking insert.

19. The golf club head of claim 18, wherein the top surface of the golf club body obstructs the view of the remaining sides of the adjustable ball striking insert when the golf club head is in an address position.

20. The golf club head of claim 18, wherein the cavity includes an aperture formed in the front surface of the club head body and through which the first side of the adjustable ball striking insert forming at least a portion of the ball striking face is visible from a front view of the golf club head.

21. The golf club head of claim 18, wherein each of the at least four sides of the adjustable golf club head are configured to form at least a portion of the ball striking surface in an in-use position.

22. The golf club head of claim 18, wherein each of the at least four sides of the adjustable ball striking face insert has groove patterns different from each of the other sides of the adjustable ball striking face insert.

* * * * *